US009004886B2

(12) United States Patent
Beck et al.

(10) Patent No.: US 9,004,886 B2
(45) Date of Patent: Apr. 14, 2015

(54) PRESSURE MONITORING SYSTEM FOR INFUSION PUMPS

(75) Inventors: Kent Beck, Layton, UT (US); Philip Eggers, Cottonwood Heights, UT (US); Larry Walker, Salt Lake City, UT (US)

(73) Assignee: Zevex, Inc., Salt Lake City, UT (US)

( * ) Notice: Subject to any disclaimer, the term of this patent is extended or adjusted under 35 U.S.C. 154(b) by 769 days.

(21) Appl. No.: 13/248,632

(22) Filed: Sep. 29, 2011

(65) Prior Publication Data

US 2012/0082576 A1 Apr. 5, 2012

Related U.S. Application Data

(60) Provisional application No. 61/388,977, filed on Oct. 1, 2010.

(51) Int. Cl.

| | |
|---|---|
| ***F04B 53/16*** | (2006.01) |
| ***F04B 43/12*** | (2006.01) |
| ***F04B 43/00*** | (2006.01) |

(52) U.S. Cl.

CPC ..... *F04B 43/1253* (2013.01); *F04B 43/0081* (2013.01); *F04B 43/1223* (2013.01); *F04B 53/16* (2013.01)

(58) Field of Classification Search

USPC ..... 417/474, 44.2, 477.2, 477.9, 423.14, 417/475, 476, 477.1, 477.3, 477.4, 477.5, 417/477.7, 477.8, 477.6, 477.11, 477.12, 417/477.13; 604/153; 73/730; 403/220, 403/291; 248/74.2, 74.4; 292/80, 81

See application file for complete search history.

(56) References Cited

U.S. PATENT DOCUMENTS

| | | | | |
|---|---|---|---|---|
| 2,899,907 | A | 8/1959 | Becher | |
| 3,209,596 | A | 10/1965 | Kelly | |
| 3,736,930 | A | 6/1973 | Georgi | |
| 3,756,752 | A * | 9/1973 | Stenner | 417/477.1 |
| 3,768,934 | A | 10/1973 | Magerle | |
| 3,790,313 | A | 2/1974 | Magerle | |
| 3,978,731 | A | 9/1976 | Reeder et al. | |
| 4,187,057 | A | 2/1980 | Xanthopoulos | |
| 4,217,993 | A | 8/1980 | Jess et al. | |
| 4,229,299 | A | 10/1980 | Savitz et al. | |
| 4,244,365 | A | 1/1981 | McGill et al. | |
| 4,322,978 | A | 4/1982 | Fromm | |

(Continued)

FOREIGN PATENT DOCUMENTS

| | | |
|---|---|---|
| DE | 2447005 | 10/1974 |
| DE | 20000965 U1 | 1/2000 |

(Continued)

OTHER PUBLICATIONS

WIPO, International Searching Authority ISA/KR, International Search Report issued May 4, 2012 in International Application No. PCT/US2011/053970.

(Continued)

*Primary Examiner* — Devon Kramer
*Assistant Examiner* — Nathan Zollinger
(74) *Attorney, Agent, or Firm* — Hodgson Russ LLP

(57) ABSTRACT

A pressure monitoring system allows for more accurate and reliable measurement of the pressure inside of a tube in a pump. The pressure monitoring system prevents movement of the tubing or a change in size of the tubing due to external forces applied to the pump, eliminating inaccuracies due to handling of the pump during use.

12 Claims, 5 Drawing Sheets

(56) References Cited

U.S. PATENT DOCUMENTS 4,322,979 A 4/1982 Fromm
4,373,525 A 2/1983 Kobayashi
4,447,191 A 5/1984 Bilstad et al.
4,460,355 A 7/1984 Layman
4,469,481 A 9/1984 Kobayashi
4,498,843 A 2/1985 Schneider et al.
4,529,401 A 7/1985 Leslie et al.
4,554,837 A 11/1985 Danby et al.
4,555,949 A 12/1985 Danby et al.
4,559,034 A 12/1985 Kirita et al.
D284,221 S 6/1986 Kerkut
4,601,700 A 7/1986 Thompson et al.
4,612,810 A 9/1986 Martens
4,624,413 A 11/1986 Corsette
4,663,965 A 5/1987 Metcalf et al.
4,762,518 A 8/1988 Kreinick
4,764,166 A 8/1988 Spani
4,784,576 A 11/1988 Bloom et al.
4,784,577 A 11/1988 Ritson et al.
4,850,807 A 7/1989 Frantz
4,857,818 A 8/1989 Hobbs
4,863,425 A 9/1989 Slate et al.
4,881,705 A * 11/1989 Kraus ..... 248/74.2
4,882,575 A 11/1989 Kawahara
4,884,013 A 11/1989 Jackson et al.
4,910,682 A 3/1990 Wolff et al.
4,913,703 A 4/1990 Pasqualucci
4,919,650 A 4/1990 Feingold et al.
4,950,244 A 8/1990 Fellingham et al.
4,973,309 A 11/1990 Sultan
4,976,687 A 12/1990 Martin
4,994,035 A 2/1991 Mokros
5,008,556 A 4/1991 Mersch
5,096,385 A 3/1992 Georgi et al.
5,098,380 A 3/1992 Aizawa et al.
5,098,384 A 3/1992 Abrams
5,099,184 A 3/1992 Hornung et al.
5,181,912 A 1/1993 Hammett
5,195,960 A 3/1993 Hossain et al.
5,201,711 A 4/1993 Pasqualucci
5,244,463 A 9/1993 Cordner, Jr. et al.
5,254,992 A 10/1993 Keen et al.
5,279,556 A 1/1994 Goi et al.
5,312,334 A 5/1994 Hara et al.
5,335,551 A * 8/1994 Ohnishi et al. ..... 73/731
5,346,477 A 9/1994 Edwards et al.
5,355,735 A 10/1994 Miller et al.
5,370,612 A 12/1994 Maeda et al.
5,395,320 A 3/1995 Padda et al.
D357,312 S 4/1995 Riquier et al.
5,438,868 A 8/1995 Holden et al.
5,482,446 A 1/1996 Williamson et al.
5,514,102 A * 5/1996 Winterer et al. ..... 604/67
5,531,680 A 7/1996 Dumas et al.
5,538,405 A 7/1996 Patno et al.
D374,718 S 10/1996 Dodge et al.
5,575,631 A 11/1996 Jester
5,630,710 A 5/1997 Tune et al.
5,657,000 A 8/1997 Ellingboe
5,683,233 A 11/1997 Moubayed et al.
D388,876 S 1/1998 Sampson
D389,228 S 1/1998 Winterer et al.
5,704,584 A 1/1998 Winterer et al.
5,720,721 A 2/1998 Dumas et al.
5,733,061 A 3/1998 Child
5,741,216 A 4/1998 Hemmingsen et al.
5,746,756 A 5/1998 Bromfield et al.
5,789,675 A 8/1998 Blaine et al.
5,791,881 A 8/1998 Moubayed et al.
5,810,323 A 9/1998 Winterer et al.
5,844,587 A 12/1998 Ando et al.
5,860,938 A 1/1999 Lafontaine et al.
5,868,712 A * 2/1999 Briggs et al. ..... 604/153
5,924,852 A 7/1999 Moubayed et al.
5,935,106 A 8/1999 Olsen
5,964,377 A 10/1999 Demarest et al.
5,983,725 A 11/1999 Fischer et al.
5,984,149 A 11/1999 Thanisch et al.
5,996,650 A 12/1999 Phallen et al.
6,017,326 A 1/2000 Pasqualucci et al.
6,023,970 A 2/2000 Blaine
6,030,359 A 2/2000 Nowosielski
6,116,472 A 9/2000 Wanbaugh et al.
6,121,739 A 9/2000 Haberlander
6,142,979 A 11/2000 McNally et al.
6,164,921 A 12/2000 Moubayed et al.
6,192,752 B1 2/2001 Blaine
6,250,164 B1 * 6/2001 O'Brien et al. ..... 73/730
6,261,262 B1 7/2001 Briggs et al.
6,328,720 B1 12/2001 McNally et al.
D455,489 S 4/2002 Beck et al.
6,371,732 B1 4/2002 Moubayed et al.
6,416,293 B1 7/2002 Bouchard et al.
6,463,813 B1 10/2002 Gysling
6,489,896 B1 * 12/2002 Platt et al. ..... 340/632
6,506,035 B1 1/2003 Beck
6,523,414 B1 2/2003 Malmstrom et al.
6,531,708 B1 3/2003 Malmstrom et al.
6,543,885 B2 4/2003 Bahl et al.
6,595,950 B1 7/2003 Miles et al.
6,623,447 B2 9/2003 Miles et al.
6,636,010 B1 10/2003 Malmstrom et al.
6,659,976 B2 12/2003 Beck et al.
6,682,500 B2 1/2004 Soltanpour et al.
6,685,670 B2 2/2004 Miles et al.
6,692,241 B2 * 2/2004 Watanabe et al. ..... 417/477.2
6,749,591 B1 6/2004 McNally et al.
6,750,468 B2 6/2004 Malmstrom et al.
D501,924 S 2/2005 Cise et al.
6,852,094 B2 2/2005 Beck et al.
D503,799 S 4/2005 Beck
D503,978 S 4/2005 Beck
D504,506 S 4/2005 Beck et al.
D505,199 S 5/2005 Beck et al.
6,902,541 B2 6/2005 McNally et al.
6,907,788 B2 6/2005 Malmstrom et al.
D507,647 S 7/2005 Beck et al.
6,923,785 B2 8/2005 Miles et al.
6,942,636 B2 9/2005 Holst et al.
6,960,080 B2 * 11/2005 Abels et al. ..... 433/10
6,979,311 B2 12/2005 Miles et al.
D523,553 S 6/2006 Beck et al.
7,070,575 B2 7/2006 Beck et al.
7,121,143 B2 10/2006 Malmstrom et al.
7,124,996 B2 * 10/2006 Clarke et al. ..... 251/7
7,150,727 B2 12/2006 Cise et al.
D536,783 S 2/2007 Cise et al.
7,207,780 B2 4/2007 Bach
7,367,963 B2 5/2008 Cise et al.
7,530,968 B2 5/2009 Gonnelli
8,486,020 B2 * 7/2013 Hills et al. ..... 604/151
2002/0169424 A1 11/2002 Miles et al.
2004/0220542 A1 11/2004 Cise et al.
2005/0004540 A1 1/2005 McNally
2005/0096593 A1 5/2005 Pope et al.
2005/0119625 A1 6/2005 Miles et al.
2005/0209563 A1 9/2005 Hopping et al.
2005/0277912 A1 12/2005 John
2006/0058740 A1 3/2006 Cise
2006/0142692 A1 6/2006 Jacobson et al.
2007/0018057 A1 * 1/2007 Kovac ..... 248/68.1
2007/0118078 A1 5/2007 McNally
2007/0151346 A1 7/2007 Malmstrom et al.
2007/0215757 A1 * 9/2007 Yuta ..... 248/68.1
2008/0098798 A1 5/2008 Riley
2008/0103445 A1 5/2008 Blaine et al.
2008/0119782 A1 5/2008 Steinman
2008/0134750 A1 6/2008 Riley
2008/0208117 A1 8/2008 Steinman
2009/0049919 A1 2/2009 Hills
2009/0129944 A1 * 5/2009 Stemple et al. ..... 417/53
2009/0149801 A1 6/2009 Crandall
2009/0254034 A1 10/2009 Beck
2011/0300010 A1 * 12/2011 Jarnagin et al. ..... 417/477.2

(56) References Cited

U.S. PATENT DOCUMENTS

FOREIGN PATENT DOCUMENTS

| | | |
|---|---|---|
| EP | 0 261 860 | 3/1988 |
| EP | 0 410 187 | 1/1991 |
| EP | 1535637 | 6/2005 |
| GB | 2 338 759 | 12/1999 |
| JP | S56-31758 | 3/1981 |
| JP | S58-163860 | 10/1983 |
| JP | H02-01805 | 8/1990 |
| JP | 05-042219 | 2/1993 |
| JP | 10-048759 | 2/1998 |
| WO | WO 96/08666 | 3/1996 |
| WO | WO 98/04301 | 2/1998 |

OTHER PUBLICATIONS

The International Bureau of WIPO, International Preliminary Report on Patentability issued in International Application No. PCT/US2011/053970 Apr. 2, 2013.

* cited by examiner

PRESSURE MONITORING SYSTEM FOR INFUSION PUMPS

PRIORITY

The present application claims the benefit of U.S. Provisional Application Ser. No. 61/388,977, filed Oct. 1, 2010 which is herein incorporated by reference in its entirety.

THE FIELD OF THE INVENTION

The present invention relates to pressure monitoring systems in pumps. More specifically, the present invention relates to a pressure monitoring system for medical pumps such as feeding pumps and infusion pumps which allows for more accurate pressure measurement in a fluid delivery tube while utilizing inexpensive components. The pressure monitoring system isolates the pressure measurement from environmental effects such as movement of the pump or, more importantly, external forces applied to the pump such as a user grasping the pump.

BACKGROUND

Medical pumps such as peristaltic pumps are commonly used to deliver fluids. In medical applications, peristaltic pumps and fluid delivery systems are used to deliver medication, nutrition, and other fluids to a patient. In these applications, it is important to monitor the pressure inside of the delivery tubing. Typically, pressure is measured and monitored before and after the pumping motor. This allows the pump to determine if a blockage is present in the tubing or if the pressure in the tubing is outside of a safe working range. Measuring the pressure may also enable the pump to more accurately determine the rate of fluid delivery.

It has been difficult to accurately measure the pressure in the delivery tubing. For medical applications, a disposable tubing set is loaded into the pump and used for a relatively short period of time. This requires that the pressure monitoring system does not interfere with the loading and unloading of the tubing. Existing pressure monitoring systems have experienced inaccuracies due to the inconsistent loading or placement of the tubing or due to external forces which are applied to the pump such as when a user grabs or moves the pump.

There is a need for a pressure monitoring system for fluid delivery pumps which more accurately measures the fluid pressure inside of the tubing. There is a need for such a system which overcomes inconsistencies in tubing placement, and which is not affected by environmental conditions such as movement or forces applied to the pump.

SUMMARY OF THE INVENTION

It is an object of the present invention to provide an improved pressure monitoring system.

According to one aspect of the invention, a pressure monitoring system is provided which allows the infusion tubing to be easily loaded and unloaded from the pump. The tubing is simply placed in a channel in the pump and the door is closed. No additional latch mechanisms are necessary.

According to another aspect of the invention, a pressure monitoring system is provided where the pressure readings are isolated from external forces acting on the pump, and acting on the pump door in particular. The pressure monitoring system thus provides a more consistent and reliable measurement of the pressure within the tubing.

These and other aspects of the present invention are realized in a pressure monitoring system as shown and described in the following figures and related description.

BRIEF DESCRIPTION OF THE DRAWINGS

Various embodiments of the present invention are shown and described in reference to the numbered drawings wherein.

It will be appreciated that the drawings are illustrative and not limiting of the scope of the invention which is defined by the appended claims. The embodiments shown accomplish various aspects and objects of the invention. It is appreciated that it is not possible to clearly show each element and aspect of the invention in a single figure, and as such, multiple figures are presented to separately illustrate the various details of the invention in greater clarity. Similarly, not every embodiment need accomplish all advantages of the present invention.

DETAILED DESCRIPTION

The invention and accompanying drawings will now be discussed in reference to the numerals provided therein so as to enable one skilled in the art to practice the present invention. The drawings and descriptions are exemplary of various aspects of the invention and are not intended to narrow the scope of the appended claims.

Figure 1:
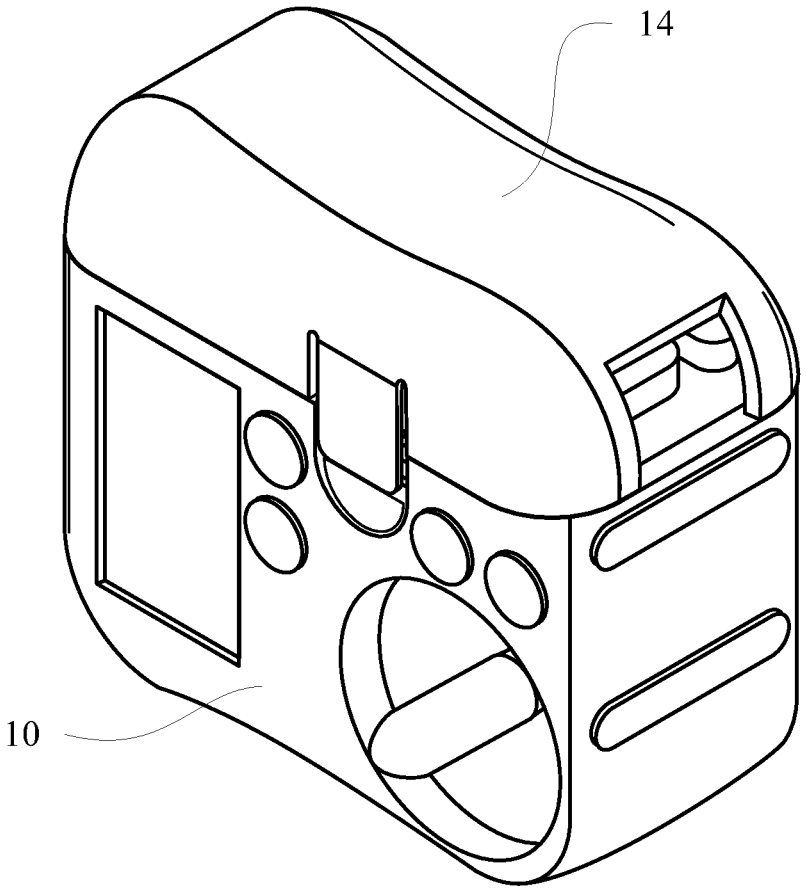
FIG. 1 shows a perspective view of a fluid delivery pump according to the present invention.

Turning now to FIG. 1, a perspective view of a pump 10 is shown. The present application applies to many types of pumps such as nutrition delivery and feeding pumps and I.V. or medication delivery pumps. For simplicity, the application simply refers to pumps or infusion pumps to indicate these types of pumps. The pump 10 is typically used for delivery of medical fluids, such as delivering medicine or nutritional solutions. Many of the controls or features of the pump 10 are known in medical peristaltic pumps, and are not discussed herein for clarity in discussing the invention. The pump 10 includes a door 14 which is closed after mounting an infusion cassette into the pump. The door 14 is used to ensure proper loading of the infusion cassette.

Figure 2:
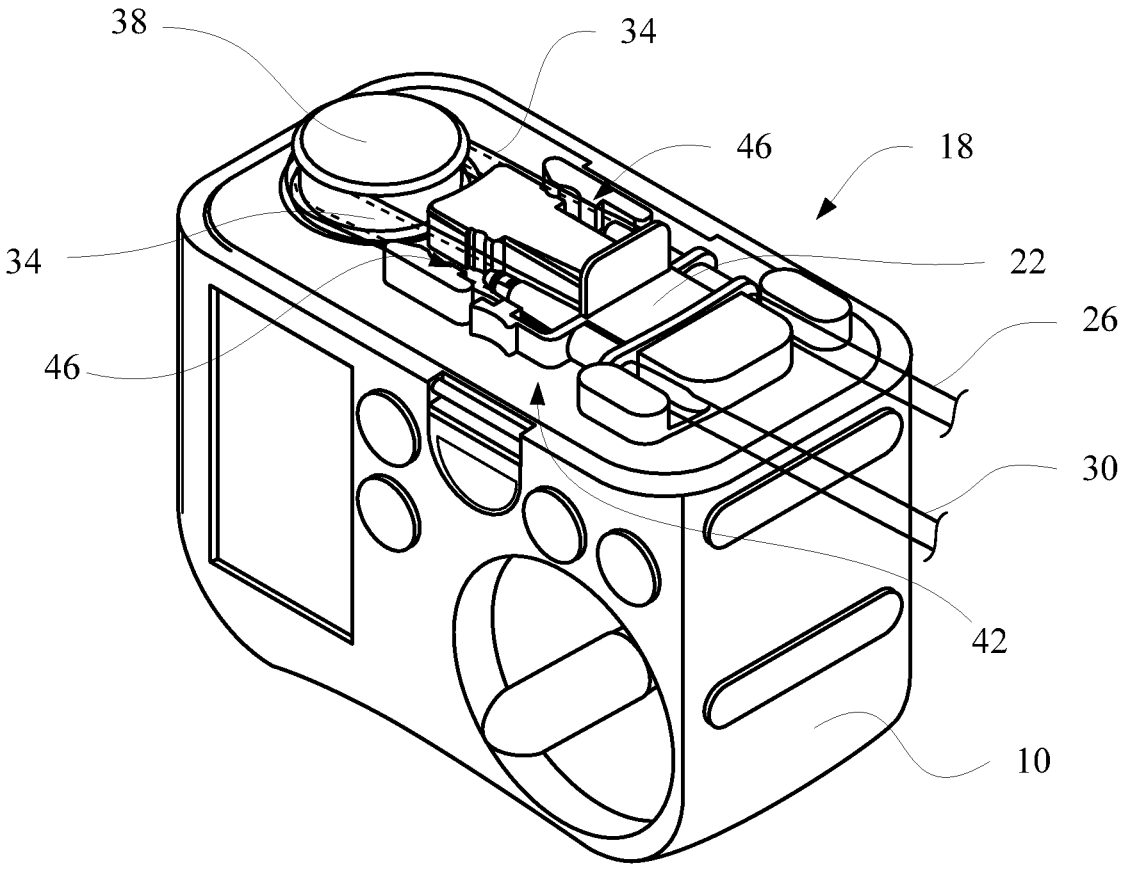
FIG. 2 shows a perspective view of the pump of FIG. 1.

FIG. 2 shows a perspective view of the pump 10 with the door 14 removed. An infusion cassette 18 is mounted in the pump. The infusion cassette 18 includes a cassette body 22, an inflow tubing 26, an outflow tubing 30 and a pump tubing 34. The pump tubing 34 is typically flexible silicone tubing. The cassette body 22 provides connectors to attach the inflow tubing 26 to the first end of the pump tubing 34 and the outflow tubing to the second end of the pump tubing. The pump tubing thus forms a loop which is stretched around the pump rotor 38. It will be appreciated, however, that the pressure monitoring system of the present invention may also be used in other pumps such as linear peristaltic pumps.

The cassette 18 is typically loaded into the pump 10 by placing the loop of pump tubing 34 over the pump rotor 38, stretching the pump tubing, and placing the cassette body 22 into a nesting area 42. The pump includes pressure monitoring channels 46. The pressure monitoring channels 46 receive the pump tubing 34 to monitor the pressure therein. It is typically desired to monitor the pressure inside the tubing both upstream and downstream from the pump rotor 38. This allows the pump 10 to more accurately determine the fluid delivery rate and allows the pump to determine if a blockage or overpressure situation has occurred.

Figure 3:
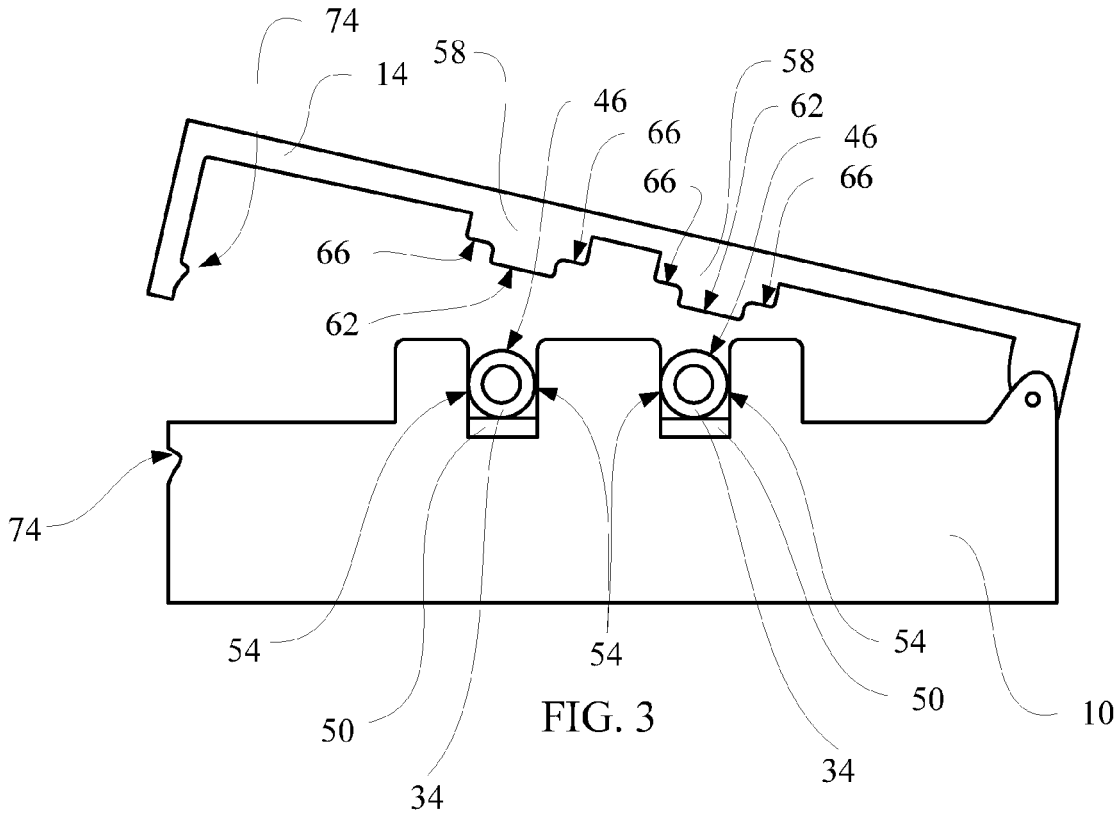
FIG. 3 shows a partial cross-sectional view of the pump of FIG. 1.

FIG. 3 shows a partial cross-sectional view of the pump 10 taken through the pressure monitoring channels 46. For clarity, not all structures are shown. The pump tubing 34 is loaded into the pressure monitoring channels 46. The pump door 14 is shown open and in a first shape. Pressure sensors 50 are located in the bottom of the channels 46. Piezoelectric crystals are typically used for the sensors 50, but other types of pressure sensors could be used. Variances in the pressure within the pump tubing 34 change the amount of force applied to the pressure sensors, providing a signal which may be used to calculate the pressure inside of the tubing 34. The sidewalls 54 of the pressure monitoring channels 46 may contact the tubing 34 in order to constrain the tubing. In this case the sidewalls 54 would be slightly narrower than the outer diameter of the tubing to limit the movement or expansion of the tubing and to slightly compress the tubing. Alternatively, the sidewalls 54 may be spaced apart from the tubing slightly to allow the tubing to more freely press against the pressure sensors 50.

The pump door 14 has pedestals 58 formed thereon which are formed in alignment with the pressure monitoring channels 46. The pedestals 58 extend downwardly from the inside of the door 14. The bottoms of pedestals 58 have a tubing contacting surface 62 and channel contacting surfaces 66. When the door 14 is closed, the tubing contacting surface 62 contacts the top of the tubing 34 and compresses the tubing slightly, pressing the tubing against the pressure sensor 50. When the door 14 is closed, the channel contacting surfaces 66 contact the top of the channels 46 and rest against the channel, preventing the pedestals 58 from moving towards the tubing 34 and further compressing the tubing. The door 14 is pivotably attached to the pump 10 via a hinge 70 and is secured close with a latch or catch 74.

Figure 4:
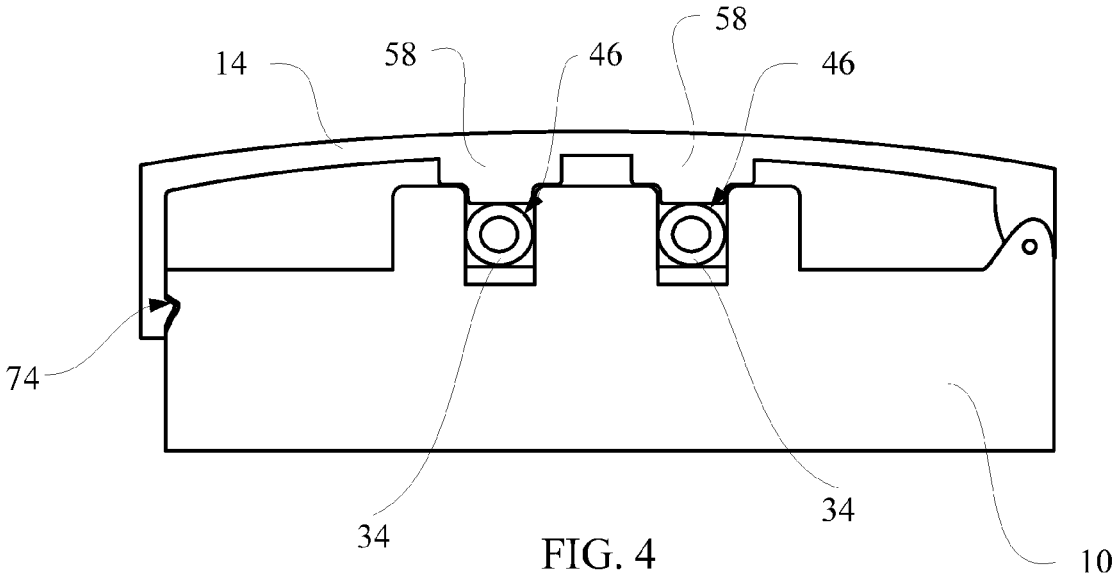
FIG. 4 shows a partial cross-sectional view of the pump of FIG. 1.

FIG. 4 shows the pump door 14 in the closed position and having a second shape. When the pump door 14 is closed, the projections 58 are pushed down against the tubing 34 and the pressure monitoring channels 46. The projections 58 are made slightly taller than the available distance between the closed pump door 14 and the channels 46, causing interference when closing the pump door. Thus, the projections 58 contact the pressure monitoring channels 46 before the pump door 14 is completely closed and the pump door is bent as shown in order to close the latch 74 and secure the pump door in a closed position. The bend in the door 14 is exaggerated to illustrate the bending of the door. In use, a slight interference and a slight bend in the door 14 is sufficient to ensure that the projections 58 are always disposed in contact with the channels 46. The portion of the pump door 14 adjacent the projections 58 is bowed outwardly relative to the rest of the pump door. This bending of the door biases the projections 58 against the pressure monitoring channels 46 and maintains contact and pressure therebetween. The contact and applied pressure between the channel contacting surfaces 66 of the projections 58 and the pressure monitoring channels 46 prevents the projections 58 from moving relative to the channels 46 when the pump is in use, moved, or grasped by a user, preventing erroneous changes in the pressure reading. Thus, the tubing 34 is held in a consistent position and is consistently held against the pressure sensor 50 with a small amount of preload. This allows for more reliable pressure monitoring.

Figure 5:
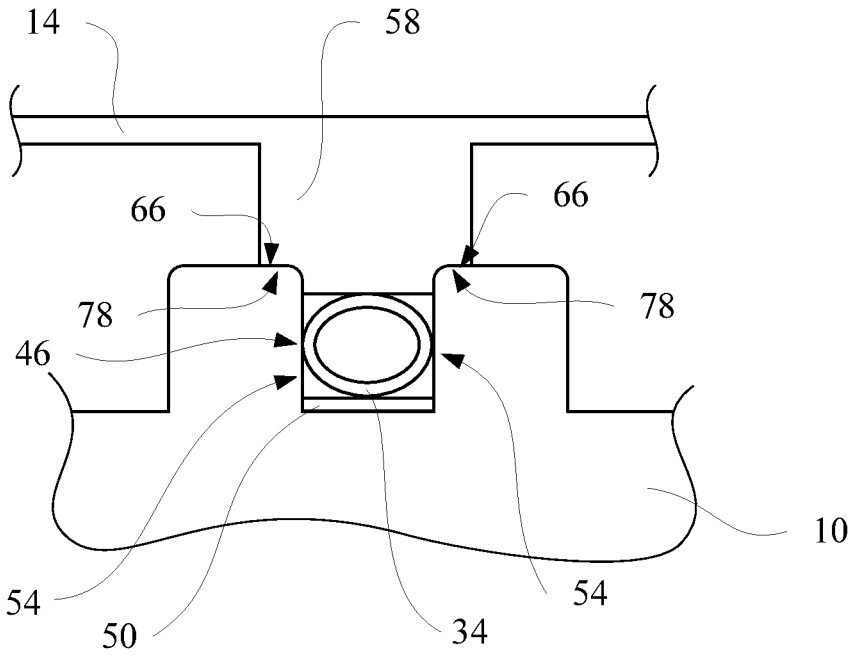
FIGS. 5 through 7 show partial cross-sectional views of the pressure monitoring channel of pump of FIG. 1.

FIG. 5 shows an enlarged view of a single projection 58 and pressure monitoring channel 46 with the pump door 14 in the closed position. The channel contacting surfaces 66 are biased towards and pressed against upper surfaces 78 of the pressure monitoring channel 46. Thus, the contact between the channel contacting surfaces 66 and upper channel surfaces 78 prevents the projection 58 from moving further towards the tubing 34 and further compressing the tubing if a person grabs the pump 10. The tubing contacting surface 62 presses against the tubing 34 and compresses the tubing slightly. In this configuration, the tubing 34 is contacted on four sides by the projection 58, channel side walls 54, and pressure sensor 50. As discussed above, the channel side walls 54 may be slightly wider than the tubing such that the tubing contacts the projection 58 and pressure sensor 50. Because the tubing 34 is loaded consistently, more accurate and consistent pressure readings are obtained. If the tubing 34 is constrained on all sides, expansive force due to pressure within the tube may be more fully directed towards the pressure sensor 50. If the tubing 34 is not contacted by the side walls 54, the tubing may more easily seat against the pressure sensor 50 and eliminate friction with the side walls as a source of error.

Figure 6:
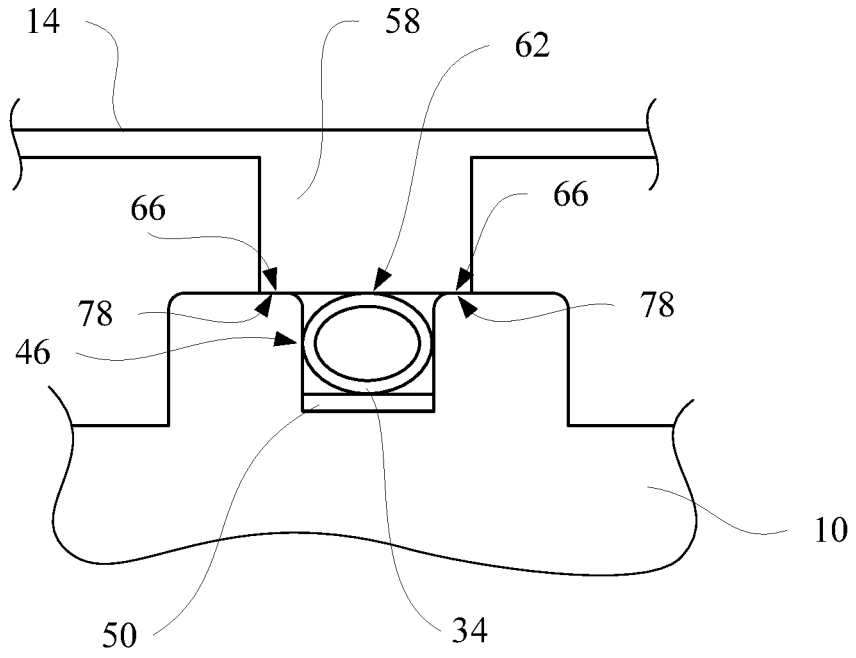

FIG. 6 shows an alternate configuration where the tubing contacting surface 62 and the channel contacting surfaces 66 are at or near the same height, or in the same plane. In this configuration, the pressure monitoring channel 46 is made slightly shallower so that the tubing 34 protrudes slightly from the channel 46 before the pump door 14 is closed, causing the tubing contacting surface 62 to press the tubing 34 downwardly when the door 14 is closed. As discussed above, the door 14 is slightly bent when fully closed to bias the projection 58 towards the channel 46 and maintain pressure between the channel contacting surfaces 66 and upper surfaces of the channel 46.

Figure 7:
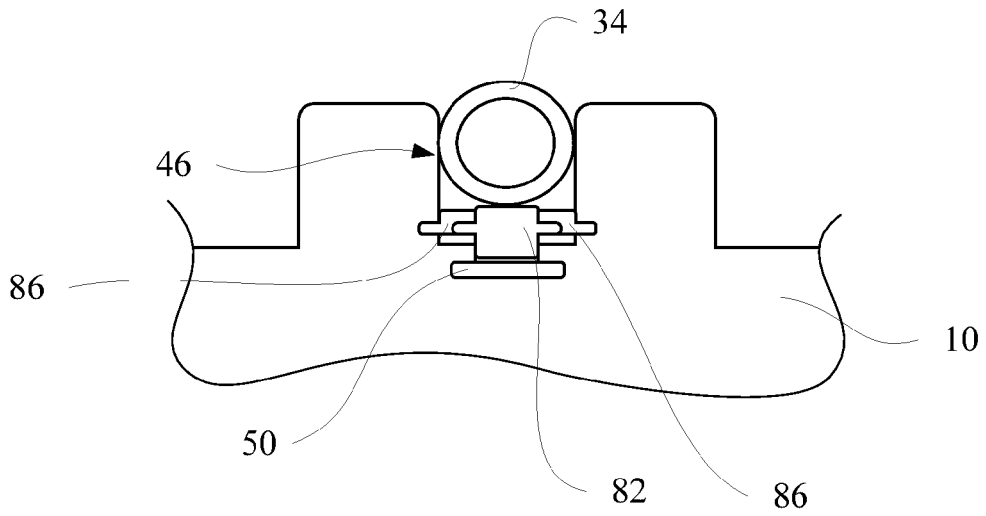

FIG. 7 shows an alternate configuration where the pressure sensor 50 is separated from the tubing 34. A rigid intermediate connecting member 82 is placed therebetween to transfer force between the tubing 34 and the pressure sensor 50. The connecting member 82 is coupled to the pump 10 by a flexible membrane 86, allowing the connecting member to move relative to the pump body and transfer force from the tubing to the pressure sensor 50. The membrane 86 seals around the connecting member 82 and isolates the pressure sensor 50 from the exterior of the pump, making the pump easier to clean and less likely to become damaged due to liquid spills around the pump. The pressure sensor configuration of FIG. 7 functions with the projection 58 as discussed above.

The pressure sensor configuration shown is advantageous in allowing for more consistent pressure measurements. The tube 34 is held against the pressure sensor 50 with a consistent amount of preload by the projection 58. The projection 58 is held against the channel with a consistent amount of preload by the slightly bent door 14, but is prevented from moving further towards the channel 46 and tube 34 by the channel contacting surfaces 66. In this manner, the tube 34 is held in a consistent position where it is unaffected by external influences such as movement of the pump or pressure placed on the pump door. Thus, the pressure sensing is more accurate where the pump is used in an ambulatory (carried with the person) application, where the pump is moved about with a hospital bed, or where a person must move the pump around.

It will be appreciated that various aspects of the invention may be combined together. Thus, for example, in accordance with principles of the present invention, a pressure monitoring system for a pump may include: a pump having a pressure monitoring channel; a tubing disposed in the pressure monitoring channel; a pressure sensor disposed in communication with the tubing to monitor the pressure in the tubing; a pump door; and a projection disposed on the inside of the pump door, the projection engaging the tubing and the pressure monitoring channel when the pump door is closed, and wherein closing the door causes a portion of the door adjacent the projection to bend outwardly and thereby bias the projection towards the pressure monitoring channel. The pressure monitoring system may also include the projection having a channel contacting surface which contacts the channel when the door is closed to thereby prevent further movement of the projection towards the channel; the channel contacting surface contacting an upper surface adjacent the channel; and/or the projection having a tubing contacting surface on the bottom thereof, the tubing contacting surface contacting the tubing and compressing the tubing when the door is closed; or combinations thereof.

In accordance with one aspect of the invention, a pressure monitoring system may include: a pump having a channel therein for receiving a flexible tubing; a tubing disposed in the channel; a pressure sensor disposed in communication with the tubing; a pump door; a projection on the pump door; and wherein, when the pump door is closed: the projection is moved adjacent the channel; the projection compresses the tubing into the channel; the projection contacts a pump surface to stop movement of the projection towards the tubing; and the projection is biased towards the tubing. The pressure monitoring system may further include a portion of the door adjacent the projection being bent outwardly when the door is closed to thereby bias the projection towards the tubing; the projection having a tubing contacting surface for contacting the surface and a channel contacting surface which contacts the channel to thereby stop movement of the projection towards the tubing; the projection having first and second channel contacting surfaces, and the first channel contacting surface contacting a first side of the channel and the second channel contacting surface contacting a second side of the channel opposite the first side; and/or channel contacting surface contacting a surface adjacent the top of the channel; or combinations thereof.

In according with an aspect of the invention, a pressure monitoring system may include a channel; a flexible tube disposed in the channel, the flexible tube being expandable due to pressure; a pressure sensor disposed in communication with the tube; a projection disposed in contact with the channel and in contact with the tube to hold the tube in the channel. The pressure monitoring system may also include: the projection having a channel contacting surface which contacts the channel to prevent movement of the projection towards the channel; the projection having a tube contacting surface which holds the tube in the channel; the tube contacting surface pressing the tube against the pressure sensor; the tube contacting surface extending into the channel; the channel being part of a pump; the projection being formed as part of a pump door; the projection having an interference fit between the pump door and the channel, causing the pump door to bend when the pump door is closed; the projection being biased towards the channel; and/or a channel contacting surface and preventing movement of the projection towards the channel; or combinations thereof.

There is thus disclosed an improved pressure monitoring system. It will be appreciated that numerous changes may be made to the present invention without departing from the scope of the claims.

What is claimed is:

1. A pressure monitoring system for a pump comprising:

a pump having a pressure monitoring channel defined by opposing sidewalls, each sidewall having an upper surface;

a tubing disposed in the pressure monitoring channel between the opposing sidewalls;

a pressure sensor disposed in communication with the tubing to monitor the pressure in the tubing;

a pump door having an inside surface and an outside surface, the door including a closure mechanism configured to releasably secure the pump door relative to the pump;

a projection disposed on the inside surface of the pump door;

wherein, in an open position, the pump door has a first shape;

wherein, in a closed position, the projection is configured to contact the upper surfaces such that the pump door is bent outwardly into a second shape and thereby bias the projection towards the pressure monitoring channel;

wherein, when the door is closed, the projection is configured to engage both the tubing and the upper surfaces of the opposing sidewalls.

2. The system of claim 1, wherein the projection has a channel contacting surface and wherein the channel contacting surface contacts the upper surfaces when the door is closed to thereby prevent further movement of the projection towards the channel.

3. The system of claim 2, wherein the projection has a tubing contacting surface on the bottom thereof, the tubing contacting surface contacting the tubing and compressing the tubing when the door is closed.

4. A pressure monitoring system comprising:

a pump having a channel therein, the channel defined by opposing sidewalls, each sidewall having an upper surface;

a tubing disposed in the channel between the opposing sidewalls;

a pressure sensor disposed in communication with the tubing;

a pump door having a first shape in an open position;

a projection on the pump door; and wherein, when the pump door is closed:

the projection is moved adjacent the channel;

the projection compresses the tubing into the channel;

the projection contacts the upper surfaces of the sidewalls to stop movement of the projection towards the tubing; and the projection is biased towards the tubing;

wherein a portion of the door adjacent the projection is configured to bend outwardly into a second shape when the door is placed in a closed position to thereby bias the projection towards the tubing.

5. The system of claim 4, wherein the projection comprises first and second channel contacting surfaces, and wherein the first channel contacting surface contacts a first side of the channel and the second channel contacting surface contacts a second side of the channel opposite the first side.

6. A pressure monitoring system comprising:

a channel defined by opposing sidewalls, each sidewall having an upper surface;

a flexible tube disposed in the channel, the flexible tube being expandable due to pressure;

a pressure sensor disposed in communication with the tube;

a projection disposed in contact with the channel and in contact with the tube to hold the tube in the channel;

a door having a first shape in an open position;

a closure mechanism configured to releasably secure the door relative to the pump;

wherein in a closed position, the projection has a channel contacting surface which is configured to contact the upper surfaces of the sidewalls to prevent movement of the projection towards the channel, and which is configured to cause the door to bend outwardly into a second shape.

7. The system of claim 6, wherein the projection has a tube contacting surface which holds the tube in the channel.

8. The system of claim 7, wherein the tube contacting surface presses the tube against the pressure sensor.

9. The system of claim 7, wherein the tube contacting surface extends into the channel.

10. The system of claim 6, wherein the channel is part of a pump.

11. The system of claim 10, wherein the projection is formed as part of the door.

12. The system of claim 6, wherein the projection is biased towards the channel.

* * * * *